US009402529B1

(12) United States Patent
Daniel

(10) Patent No.: US 9,402,529 B1
(45) Date of Patent: Aug. 2, 2016

(54) DOORMAT FOR DISPENSING FLUID STORED WITHIN

(71) Applicant: Isaac S. Daniel, Miramar, FL (US)

(72) Inventor: Isaac S. Daniel, Miramar, FL (US)

( * ) Notice: Subject to any disclaimer, the term of this patent is extended or adjusted under 35 U.S.C. 154(b) by 577 days.

(21) Appl. No.: 13/725,852

(22) Filed: Dec. 21, 2012

Related U.S. Application Data

(63) Continuation-in-part of application No. 29/414,772, filed on Mar. 2, 2012, now Pat. No. Des. 674,641.

(51) Int. Cl.
*A47L 23/26* (2006.01)
*A47K 7/02* (2006.01)
*B08B 1/00* (2006.01)

(52) U.S. Cl.
CPC ..... *A47L 23/266* (2013.01); *A47K 7/026* (2013.01); *B08B 1/00* (2013.01)

(58) Field of Classification Search
CPC .. B08B 1/00; A46B 2200/3073; A47K 7/024; A47K 7/026; A63B 57/0087; A47L 23/266; A47L 23/02; A47L 23/22
USPC ..... 15/30, 36, 104.92, 105, 215
See application file for complete search history.

(56) References Cited

U.S. PATENT DOCUMENTS

| | | | | |
|---|---|---|---|---|
| 3,300,275 | A * | 1/1967 | Lorman | 118/264 |
| 6,662,398 | B1 * | 12/2003 | Thomson | 15/104.92 |
| 2002/0023308 | A1 * | 2/2002 | Blum et al. | 15/104.002 |
| 2002/0178528 | A1 * | 12/2002 | Koch | A47L 23/263 15/310 |
| 2003/0029477 | A1 * | 2/2003 | Dean | A47L 23/266 134/6 |
| 2006/0236487 | A1 * | 10/2006 | Dean | 15/215 |

* cited by examiner

*Primary Examiner* — Robert Scruggs
(74) *Attorney, Agent, or Firm* — Carol N. Green Kaul

(57) ABSTRACT

The present invention includes a doormat comprising of a base including a mat element and a bottom portion for engaging with a supporting surface; pipes interconnected to each other disposed in a formation, wherein disposed periodically along the pipes is at least one miniature can for receipt of fluid to be piped through the pipes, which themselves include a plurality of holes for the dispensed fluid, to be dispensed therethru when the pressure is exerted on the upper surface element of the doormat, which comprises of a brush member with at least one main aperture for providing access to the at least one miniature can disposed along the pipes and one or a plurality of minor apertures for permitting the dispensed fluid to reach the upper surface thereby eliminating germs from being carried from one location to another.

10 Claims, 3 Drawing Sheets

DOORMAT FOR DISPENSING FLUID STORED WITHIN

PRIORITY CLAIM

This patent application is a non-provisional patent application and claims priority under 35 U.S.C. §119(e) to: U.S. Design patent application Ser. No. 29/414,772 titled Doormat For Dispensing Fluid Stored Within, filed Mar. 2, 2012, which is hereby incorporated by reference as if fully stated herein.

FIELD OF THE INVENTION

The present invention relates to a doormat comprising of a base including a mat element provided thereon and including a bottom portion for engaging with a supporting surface; pipes interconnected to each other in a formation, wherein disposed periodically along the pipes are at least one miniature can for receipt of fluid to be piped through the pipes and dispensed when pressure is exerted on an upper surface element of the doormat; and the upper surface element comprising of a brush member with at least one major aperture for providing access to the at least one miniature can disposed along the pipes as well as at least one or more minor apertures for allowing the dispensed fluid piped through the pipes to access the upper surface when the pressure of at least one bare foot or shoe engages an upper surface element of the doormat. The upper surface element comprises of a brush member with at least one main aperture for providing access to the at least one miniature can disposed along the pipes and one or a plurality of minor apertures for permitting the dispensed fluid to reach the upper surface thereby eliminating germs from being carried from one location to another.

BACKGROUND

Various kinds of doormats have been used over the years to reduce or eliminate dirt and debris from entering an inside location. Some examples of doormats include cloth, plastic materials, and metallic coil spring bonded in a state of sheet or pile, or synthetic resin with extruded fibers. However, the aforementioned doormats still fail to address the issue of reducing and/or eliminating in a significant manner, germs that are stuck on shoes or bare feet. Specifically, cloth doormats are very unpopular as they are not waterproof, wholly plastic doormats are similarly unsuitable as they can become slippery when wet and could become a health hazard for trips and falls. Metallic doormats are noted for having difficulty in extracting dirt and debris from shoes since it requires the crushing of metallic coil springs. As a result, there still exists a need to be able to effectively eliminate dirt, debris and germs using a doormat as a first line of defense in entering a location.

This invention satisfies these long felt needs in a new and novel manner and solves the foregoing problems that the prior art has been unable to resolve.

SUMMARY

The invention relates to a doormat comprising of a base including a mat element provided thereon and including a bottom portion for engaging with a supporting surface with pipes interconnected to each other in a formation, wherein disposed periodically along the pipes are at least one or more miniature cans for receipt of fluid to be piped through the pipes and dispensed when pressure is exerted on an upper surface element of the doormat. The upper surface element comprises of a brush member with at least one major aperture for providing access to the at least one or more miniature cans disposed along the pipes and at least one or a plurality of minor apertures for allowing the dispensed fluid piped through the pipes to access the upper surface element when pressure is exerted thereon.

It is understood that the doormat may be configured in any geometrical shape, i.e. oblong, rectangle, square, circle, and the like. In some embodiments, the shape of the doormat influences the placement of the at least one or more miniature cans. For instance, in a rectangular arrangement of the pipes, the at least one or more miniature cans may be disposed on the four corners of the doormat for even distribution of the dispensed fluid, i.e. disinfectant. However, it is understood that the miniature cans could easily have been disposed in any other location along the pipes.

The pipes may be disposed in a grid formation, e.g. running longitudinally and/or horizontally and/or in a crisscross pattern, and are further disposed in between the mat element and an upper surface element. The pipes include at least one or a plurality of holes disposed along the outer circumference of the pipes for the dispensing of fluid, such that once a barefoot or shoe is engaged with the upper surface element of the doormat, the weight of the individual as transposed through a bare foot or shoe exerts pressure on the doormat causing the pipes disposed within to dispense the disinfectant fluid contained therein. The pipes may be made of rubber or plastic which provides a cushion for pressure to be exerted without crushing the pipes.

In some embodiments, the doormat includes a pressure sensor to sense a minimum amount of pressure such that it does not inadvertently dispense fluid unnecessarily. For instance, the pressure sensor maybe calibrated to detect light weights, e.g. a dropped empty bottle but still is sensitive enough to detect a baby's feet which may need to be disinfected.

The mat element includes a plate with a recessed portion configured for receiving the pipes and the at least one or more miniature cans to be fitted therein. It is understood that the pipes' configuration will determine the shape of the recessed portion as the pipes necessarily must fit securedly within the recessed portion for safety reasons.

The upper surface element of the doormat comprises of a brush member that is securedly affixed to the plate and includes a pad comprising of a plurality of miniature monofilament elements for engaging at a minimum the lower surface of a shoe or bare feet. The monofilament elements may be made of synthetic waterproof materials as were well known and used in the arts.

For a further and more fully detailed understanding of the present invention, various objects and advantages thereof, reference is made to the following detailed description and the accompanying drawings.

Additional objectives of the present invention will appear as the description proceeds.

The foregoing and other objects and advantages will appear from the description to follow. In the description, references are made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

DESCRIPTION OF THE DRAWINGS

A Doormat for Dispensing Fluid Stored Within of which the following is the specification with reference being made to the accompanying drawings forming a part hereof.

DETAILED DESCRIPTION OF PREFERRED EMBODIMENTS

Figure 1:
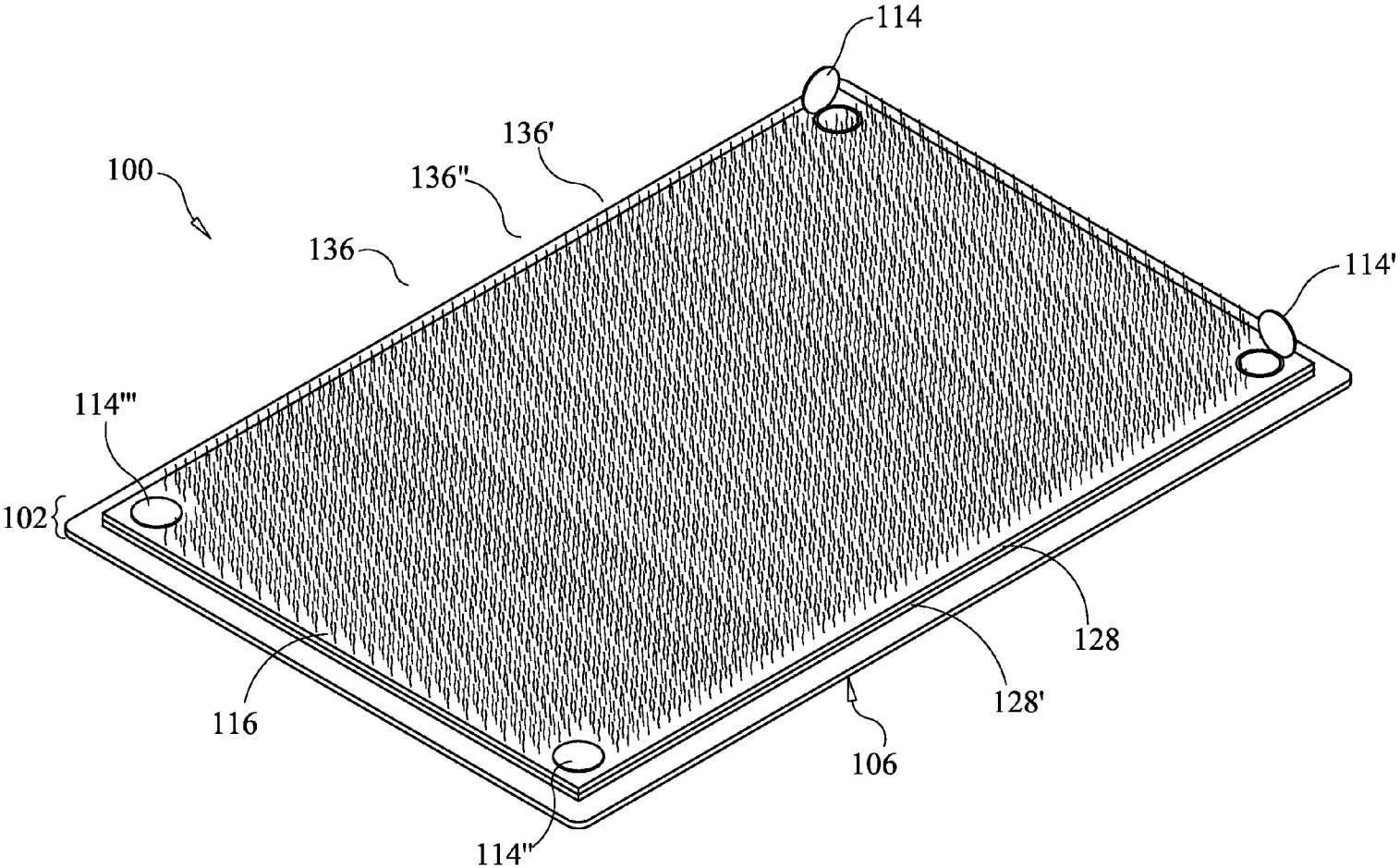
FIG. 1 is a perspective view of a doormat for dispensing fluid stored within.

The following discussion describes in detail an embodiment of the doormat for dispensing fluid stored within as described below. However, this discussion should not be construed, as limiting the invention to those particular embodiments, as practitioners skilled in the art will appreciate that the doormat may vary as to configuration and as to details of the parts, without departing from the basic concepts as disclosed herein. Similarly, the elements described herein may be implemented separately, or in various combinations without departing from the teachings of the present invention. For definition of the complete scope of the invention, the reader is directed to appended claims. Turning now descriptively to the drawings, in which similar reference characters denote similar elements throughout the several views.

FIG. 1 is a perspective view of a doormat 100 for dispensing fluid stored within. The invention comprises of a doormat 100 comprising of a base 102 including a mat element 104 provided thereon and including a bottom portion 106 for engaging with a supporting surface; with pipes 108, 108' interconnected to each other in a formation, wherein disposed periodically along the outer circumference 110 of the pipes 108, 108' are at least one or more miniature cans 112, 112' with covers 114, 114' for receipt of fluid to be piped through the pipes 108, 108' and dispensed whenever the pressure of at least one bare foot or shoes engages an upper surface element 116 of the doormat 100.

Figure 2:
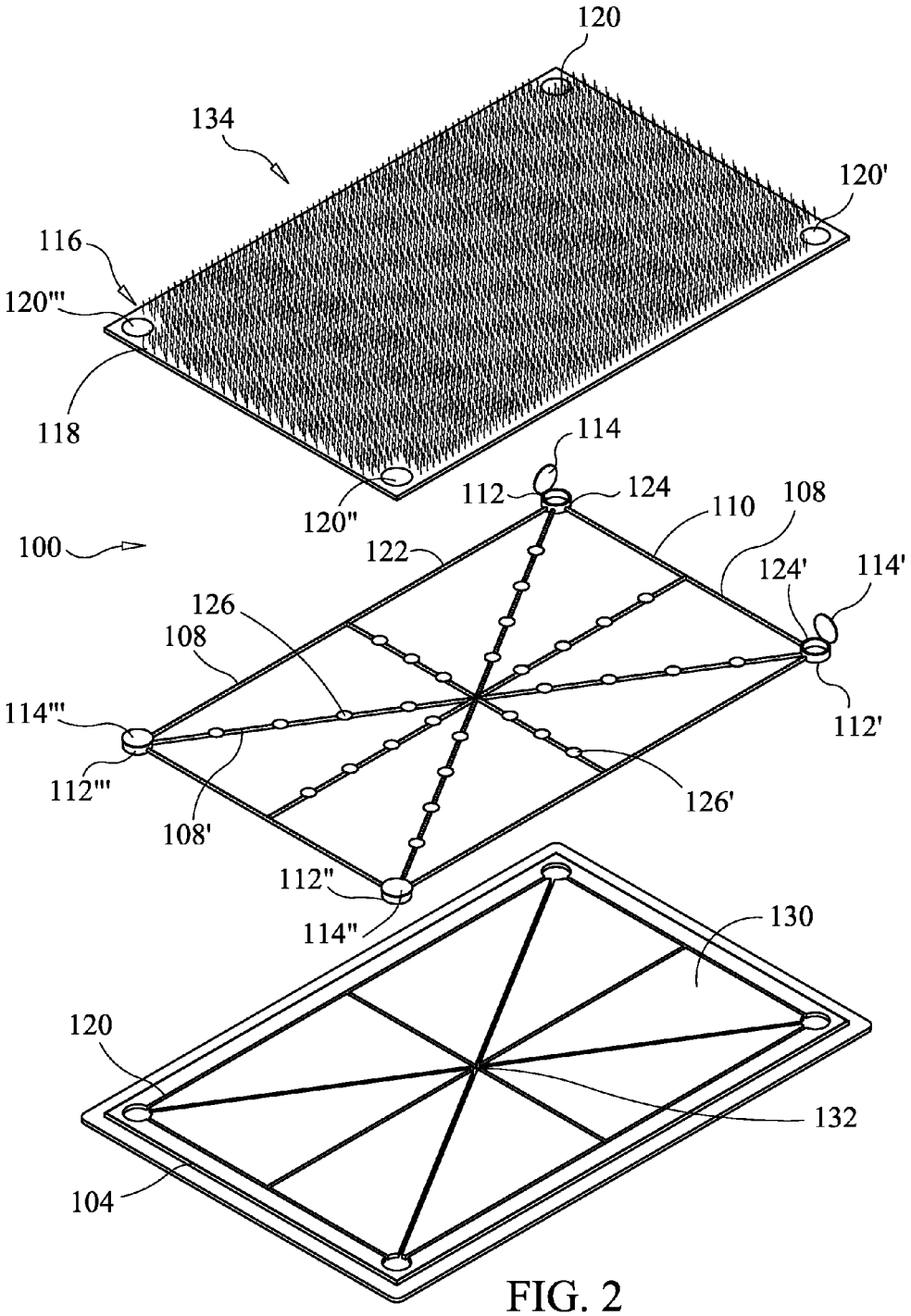
FIG. 2 is an exploded view of the doormat according to one embodiment of the invention.
Figure 3:
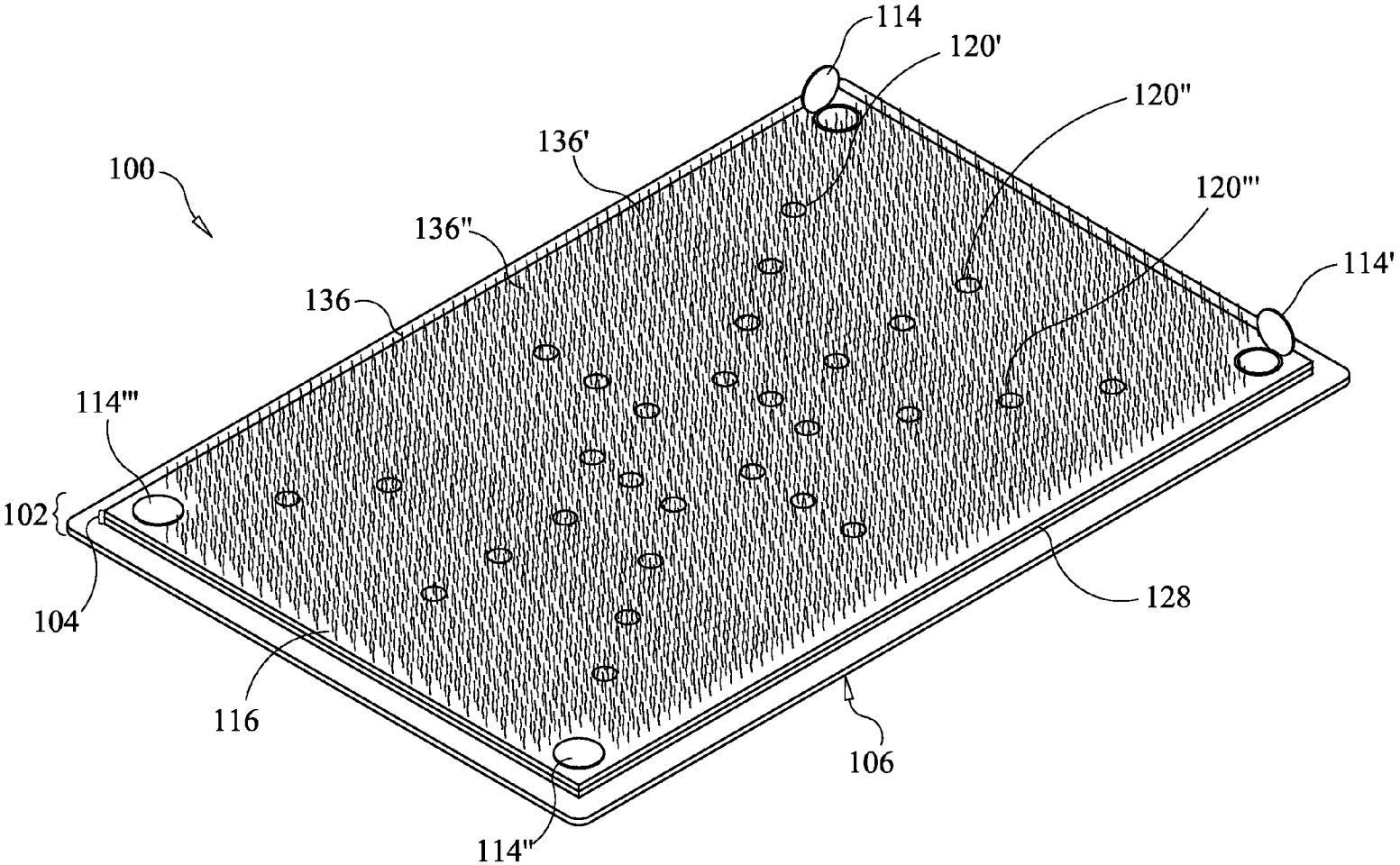
FIG. 3 is a top plan of a doormat for dispensing fluid stored within.

As shown in FIGS. 1 & 2, the upper surface element 116 comprises of a brush member 118 with at least one aperture 120 for providing access to the at least one miniature can 112 disposed along the pipes 108, 108' and at least one or more minor apertures 120', 120" for allowing the dispensed fluid piped through the pipes 108, 108' to access the upper surface element 116 when pressure is exerted thereon. It is understood that the doormat 100 may be configured in any geometrical shape, i.e. oblong, rectangle, square, circle, rhombus, triangle and the like. Accordingly, the piping 106, 106' within may be configured in any geometrical shape to accommodate the shape of the doormat 100. In one embodiment, the doormat 102 is configured in a rectangular shape and the miniature cans 112, 112' are disposed on the outer perimeter 122 of the rectangle. In the embodiment shown in FIG. 2, the miniature cans 112, 112' are disposed on the four corners 124, 124', 124", 124'" of the pipes' outer perimeter 122 but it is understood that the miniature cans 112, 112' could easily have been disposed in any other location along the pipes 108, 108' for replenishing the doormat with dispensing fluid and the dispensing thereof.

In an exemplary embodiment, the pipes 108, 108' may be disposed in a grid formation, e.g. running longitudinally and/or horizontally and/or in a crisscross pattern interconnected to each other. The pipes 108, 108' are further disposed in between the mat element 104 and an upper surface element 116 and include a plurality of holes 126, 126' disposed along the outer circumferences 110, 110 of the pipes 108, 108' for the dispensing of fluid, such that once a barefoot or shoe is engaged with the upper surface element 116 of the doormat 100, the weight of the individual as experienced by a bare foot or shoe exerts pressure on the doormat 102 causing the pipes 108, 108' to dispense the disinfectant fluid contained therein. The pipes 108, 108' may be made of rubber or plastic, which provides a cushion for pressure to be exerted on the pipes disposed on the inner layer of the doormat 102 without crushing the pipes. 106, 106'.

In some embodiments, doormat 102 includes at least one or more pressure sensors 128, 128' such that it will sense a certain amount of pressure and does not inadvertently dispense fluid unnecessarily. For instance, the at least one pressure sensor 128 may be calibrated to detect light objects, e.g. a dropped empty bottle but still be sensitive enough to detect a baby's feet which may need to be disinfected.

The mat element 104 includes a plate 130 with a recessed portion 132 configured for receiving the pipes 108, 108' and the at least one or more miniature cans 112, 112' to be fitted therein. It is understood that the pipes' 106, 106' configuration will determine the shape of the recessed portion 124 or vice versa as the pipes 108, 108' necessarily must securedly fit within the recessed portion 124 for safety reasons.

The upper surface element 116 of the doormat 102 comprises of a brush member 118 that is securedly affixed to the plate 130 and said brush member 118 includes a pad 134 comprising of a plurality of miniature monofilament elements 136, 136', 136" for engaging the lower surface of a shoe or bare feet. The miniature monofilament elements 136, 136', 136" may be made of synthetic waterproof materials made of plastic or resin as were well known and used in the arts.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A doormat comprising of:

a base including a mat element provided thereon and including a bottom portion for engaging with a supporting surface;

pipes interconnected to each other in a formation, wherein disposed periodically along the pipes are at least one or more miniature cans with a body extending from the mat element to an upper surface element with covers detachably affixed at the upper surface element that are enabled for receiving and retaining fluid that is piped through the pipes and dispensed to the pipes when pressure is exerted on an upper surface element of the doormat causing the dispensed fluid to be dispensed through at least one or more minor apertures along the pipes; and the upper surface element comprising of a brush member securedly affixed to a plate with at least one major aperture from which the covers can be detachably removed to access the at least one or more miniature cans.

2. The doormat according to claim 1, wherein the brush member comprises of at least one minor aperture for allowing the dispensed fluid piped through the pipes to access the upper surface element when pressure is exerted thereon.

3. The doormat according to claim 1, wherein the pipes are disposed in a grid formation.

4. The doormat according to claim 2, wherein the grid formation comprises of the pipes running longitudinally and horizontally.

5. The doormat according to claim 1, wherein the pipes are further disposed in between the mat element and an upper surface element.

6. The doormat according to claim 1, wherein the pipes includes at least one or a plurality of holes disposed along the outer circumference of the pipes for the dispensing of fluid.

7. The doormat according to claim 1, wherein the mat element includes a plate with a recessed portion configured for receiving the pipes and the miniature cans to be fitted therein.

8. The doormat according to claim 1, wherein the brush member includes a pad comprising of a plurality of miniature monofilament elements.

9. The doormat according to claim 1, further comprising at least one pressure sensor that detects an amount of pressure applied to the doormat.

10. The doormat according to claim 9, further comprising the at least one pressure sensor calibrated for detecting pressure applied to the doormat.

* * * * *